US007377626B2

(12) United States Patent
Holland et al.

(10) Patent No.: US 7,377,626 B2
(45) Date of Patent: May 27, 2008

(54) EXTERNAL INK SUPPLY BAG AND METHOD OF FILLING THE SAME

(75) Inventors: Carl W. Holland, Webster, NY (US); William A. Putman, Franklin, TN (US)

(73) Assignee: Nukote International, Inc., Franklin, TN (US)

( * ) Notice: Subject to any disclaimer, the term of this patent is extended or adjusted under 35 U.S.C. 154(b) by 193 days.

(21) Appl. No.: 10/886,741

(22) Filed: Jul. 9, 2004

(65) Prior Publication Data

US 2006/0007279 A1 Jan. 12, 2006

(51) Int. Cl.
*B41J 2/17* (2006.01)

(52) U.S. Cl. ..... 347/84

(58) Field of Classification Search ..... 347/86, 347/85, 87, 7

See application file for complete search history.

(56) References Cited

U.S. PATENT DOCUMENTS

| | | | | |
|---|---|---|---|---|
| 4,680,696 | A | 7/1987 | Ebinoma et al. | |
| 4,831,389 | A | 5/1989 | Chan | |
| 4,977,413 | A | 12/1990 | Yamanaka et al. | |
| 5,159,348 | A | 10/1992 | Dietl et al. | |
| 5,367,328 | A | 11/1994 | Erickson | |
| 5,469,201 | A | 11/1995 | Erickson et al. | |
| 5,912,688 | A * | 6/1999 | Gragg | 347/86 |
| 6,164,766 | A * | 12/2000 | Erickson | 347/85 |
| 6,264,318 | B1 | 7/2001 | Oda et al. | |
| 6,267,474 | B1 * | 7/2001 | Mochizuki | 347/86 |
| 6,644,794 | B1 * | 11/2003 | Wilson et al. | 347/86 |
| 7,008,051 | B2 | 3/2006 | Akermalm | |

FOREIGN PATENT DOCUMENTS

JP 2003159811 A * 6/2003

OTHER PUBLICATIONS

International Search Report for International Application No. PCT/US05/24182.
International Search Report for International Application No. PCT/US2005/024169.

* cited by examiner

*Primary Examiner*—K. Feggins
(74) *Attorney, Agent, or Firm*—Fay Sharpe LLP

(57) ABSTRACT

An ink reservoir bag of flexible, plastic sheet material for an ink delivery system for an ink cartridge is constructed of two sheets of plastic material having peripheral edges bonded together to provide an ink chamber therebetween and has separate fill and exit ports opening into the chamber and respectively defined by a fill tube and an exit tube bonded to the bag between the peripheral edges thereof. Flexible tubing is connected to the exit port through a check valve interposed between the port and tubing, and a lure lock is interconnected with the fill tube to provide an injection sight for filling the bag. The bag is filled by connecting the tubing to a vacuum source, evacuating air from the bag and tubing, connecting the fill port to a source of ink and using the negative pressure to draw ink into the bag and tubing.

16 Claims, 2 Drawing Sheets

EXTERNAL INK SUPPLY BAG AND METHOD OF FILLING THE SAME

BACKGROUND OF THE INVENTION

This invention relates to the art of ink jet printers and, more particularly, to a reservoir bag for use in an ink delivery system for the continuous refill of disposable ink jet cartridges.

Disposable ink jet cartridges are of course well known and are designed to operate for a useful life during which the head elements will function appropriately a very high percentage of the time during the life of the cartridge. To insure high performance, such cartridges have a predetermined amount of ink contained therein, and the amount of ink in the cartridge is a function of the quantity of printing that the printhead element can do before failing to function at the desired high performance level. When the ink in the cartridge is used up, the cartridge is thrown away. Most often, the printhead of the empty cartridge is still adequately functional and, therefore, it is wasteful to discard the cartridge. Furthermore, frequent replacement of ink jet cartridges is expensive from the standpoint of product usage and is inefficient with respect to the time and energy required of a user making these changes.

Systems have been provided heretofore for refilling ink jet cartridges in order to prolong the life thereof. Such systems have included the manual refilling of cartridges, such as through the use of refill kits, refilling through the use of systems including valves and pumps, as shown in U.S. Pat. No. 4,680,696 to Ebinuma, et al., for example, and continuous ink refill systems such as those shown, for example, in U.S. Pat. No. 4,831,389 to Chan, U.S. Pat. No. 5,159,348 to Dietl, et al., and U.S. Pat. No. 5,469,201 to Erickson, et al., all of which are incorporated herein by reference for background information. In a system of continuous ink supply such as that to which the present invention is directed, ink is continuously supplied to a cartridge from a remotely located ink reservoir bag through flexible tubing between the bag and cartridge. The reservoir bag is located in the printer below the cartridge and ink is drawn into the cartridge from the reservoir bag by a slight vacuum that is created as the ink within the cartridge is depleted. The reservoir bag is positioned below the cartridge to prevent flooding of the cartridge which can occur if the bag is positioned above the cartridge. More particularly in this respect, flooding can occur if the bag is above the cartridge such that the head pressure of the ink in the supply line causes ink to be forced out of the cartridge nozzles. In contrast, if the remote ink supply is positioned too far below the cartridge, the vacuum within the cartridge will not be sufficient to pull the ink into the cartridge from the reservoir bag. This is especially true during the early life of the cartridge and filling system when the continuity of the ink supply is most susceptible to interruption. Such susceptibility to interruption is due to the existence of air bubbles in the reservoir bag and tubing which results from the filling and/or storage process. If these air bubbles are large enough, they can interrupt the siphoning effect which enables the ink to flow upward from the reservoir bag to the cartridge. Accordingly, there is a very narrow operating window for the position of the reservoir bag relative to the cartridge and, since all of the ink in the reservoir bag must fall within the operating window in order for the bag to be depleted of ink, the size of the reservoir bag can be severely limited. Other concerns exist with respect to maximizing the utilization of space for the reservoir bag and maximizing the quantity of the volume of ink therein which is withdrawn from the reservoir bag.

SUMMARY OF THE INVENTION

According to the present invention, an improved ink reservoir bag is provided for an ink delivery system for the continuous refilling of an ink jet cartridge which advantageously minimizes and/or overcomes the foregoing and other disadvantages encountered in connection with the use of ink reservoir containers heretofore available. In part in this respect, the ink reservoir bag according to the present invention is formed of flexible plastic sheet material and has a structure which provides for containing a desired volume of ink for a given application and for optimizing depletion of the volume of ink from the bag during use. Further, the structure provides a thin profile for the bag and thus a small head height variation over the life of the bag from the full to the empty condition thereof. More particularly in this respect, the bag, when filled with ink, has length, width, and height dimensions which provide an Aspect Ratio which, preferably, is in excess of four. The Aspect Ratio is the smaller of the length and width dimensions divided by the height. The low profile provided by an Aspect Ratio greater than four maximizes the quantity of ink delivered from the bag and, thus, minimizes ink loss. With respect to depleting the ink from the bag during use, the flexible sides of the bag collapse together as the bag is emptied and, as the sides collapse together, a thin channel is formed which permits ink to flow by capillary actions from all areas of the bag to the exit port thereof. Further in this respect, the capillary action increases as the ink is depleted and the channel narrows.

In accordance with another aspect of the invention, the bag has separate fill and exit ports, and the exit port is connected by flexible tubing to an ink cartridge to be supplied with ink from the bag. The separate fill and exit ports advantageously facilitate filling the bag in a manner which minimizes air bubbles in the ink delivery system to a cartridge. In part in this respect, filling is achieved by first drawing a vacuum on the reservoir bag and the tubing connected to the exit port and then introducing ink into the fill port using the negative vacuum to achieve the filling. Preferably, the bag is overfilled so as to create a slight positive pressure within the bag which enables a more effective purging of air bubbles from the bag and tubing into the cartridge where the air bubbles pose no ink flow interruption problems. The slight positive pressure will be at a maximum during the early life of the cartridge and the ink supply system when it is most beneficial for dispersing air bubbles within the system, and the positive pressure will diminish progressively over time as ink is depleted from the reservoir bag.

BRIEF DESCRIPTION OF THE DRAWINGS

The foregoing advantages of the present invention and others, will in part be obvious and in part pointed out more fully hereinafter in conjunction with the written description of a preferred embodiment of the invention illustrated in the accompanying drawings in which.

DESCRIPTION OF PREFERRED EMBODIMENTS

Figure 1:
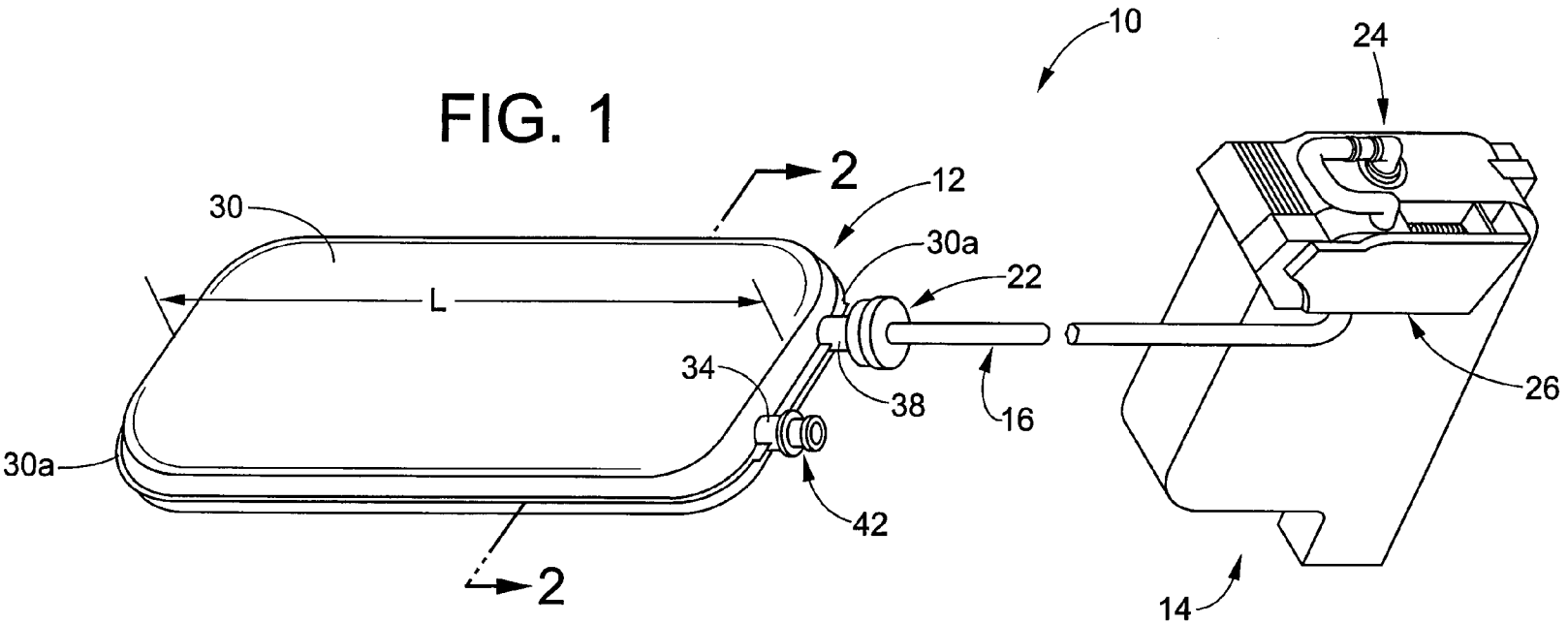
FIG. 1 is a perspective view of an ink delivery system including a reservoir bag in accordance with the invention.
Figure 2:
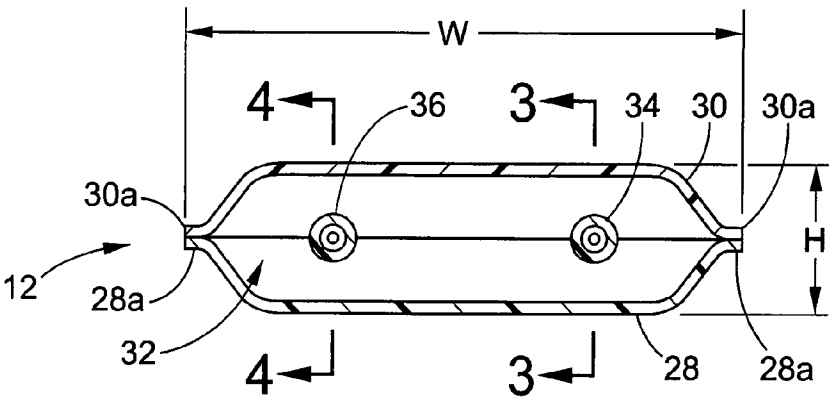
FIG. 2 is a cross-sectional view through the reservoir bag taken along line 2-2 in FIG. 1.
Figure 3:
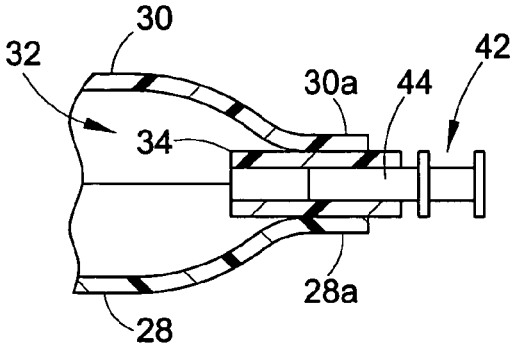
FIG. 3 is an enlarged sectional elevation view through the fill port of the bag taken along line 3-3 in FIG. 2.
Figure 4:
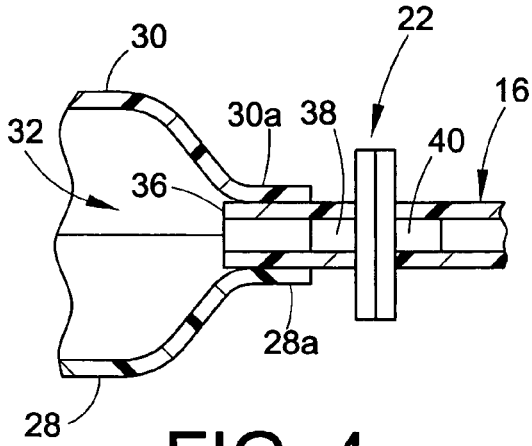
FIG. 4 is an enlarged sectional elevation view through the exit port of the bag taken along line 4-4 in FIG. 2; and, FIG. 5 is a somewhat schematic illustration of the component parts in a system for filling the reservoir bag with ink.

Referring now in greater detail to the drawings, wherein the showings are for the purpose of illustrating preferred embodiments of the invention only and not for the purpose of limiting the invention, an ink delivery system 10 includes an ink reservoir bag 12 in accordance with the present invention, an ink cartridge 14 to be supplied with ink from the reservoir bag and a flexible ink supply tube 16 connecting the cartridge with the reservoir bag as set forth hereinafter. A check valve 22 is provided in supply tubing 16 for precluding the back flow of ink into the reservoir bag, and the cartridge is provided with a fitting 24 for connecting the supply tubing to the cartridge. Preferably, the tubing extends through a tube clamping and strain relief device 26 mounted on the cartridge and which is operable to open tubing 16 when the cartridge is installed on a printer. As shown in FIGS. 1-4, bag 12 is defined by a pair of sheets of flexible plastic material 28 and 30 having corresponding peripheral edges 28*a* and 30*a* which overlie one another and are bonded together, such as by heat sealing, to provide an ink chamber 32 therebetween. Sheets 28 and 30 are preferably polyvinylchloride sheets having a thickness of 0.015 inch. When filled with ink as depicted in FIGS. 1-4, the bag has a length L, a width W, and a height H which, in accordance with one aspect of the invention, provide an Aspect Ratio which is preferably greater than four. The Aspect Ratio, as mentioned hereinabove, is the lesser of the length and width dimensions divided by the height dimension. In a preferred embodiment, the bag has a length of 8 inches, a width of 3⅜ inches, and height when filled of ¾ inch, whereby the Aspect Ratio for the bag is 4.5.

In accordance with another aspect of the invention, reservoir bag 12 has separate fill and exit ports respectively defined by fill and exit tubes 34 and 36 which extend between and are bonded to sheets 28 and 30 along the perimeter of the bag as defined by peripheral edges 28*a* and 30*a* of the sheets. Preferably, the fill and exit ports extend through the periphery of the bag along one of the narrower dimensions as defined by width W, and the tubes are bonded to the sheets such as by a heat seal or through the use of a suitable adhesive. The tubes have inner ends which open into chamber 32 and outer ends which extend a short distance beyond the outermost ends of peripheral edges 28*a* and 30*a* of the sheets.

In a preferred embodiment, fill tube 34 has an inner diameter of 0.24 inch, an outer diameter of 0.30 inch, and a length of 0.75 inch, and exit tube 36 has an inner diameter of 0.17 inch, an outer diameter of 0.25 inch, and a length of 0.75 inch. Check valve 22 is interposed between exit tube 36 and tubing 16 and, in this respect, includes an inlet stem 38 received in the outer end of tube 36 and an outer stem 40 received in supply tubing 16. Fill tube 34 provides an injection sight for a lure lock component 42 having a stem 44 received in the outer end of tube 34. Preferably, supply tubing 16 has an inner diameter of 0.12 inch and is a silicone tubing having a durometer hardness of 50. However, it will be appreciated that PVC or vinyl tubing having durometer values in the range of 65-70 can be used as well as other tubing.

Figure 5:
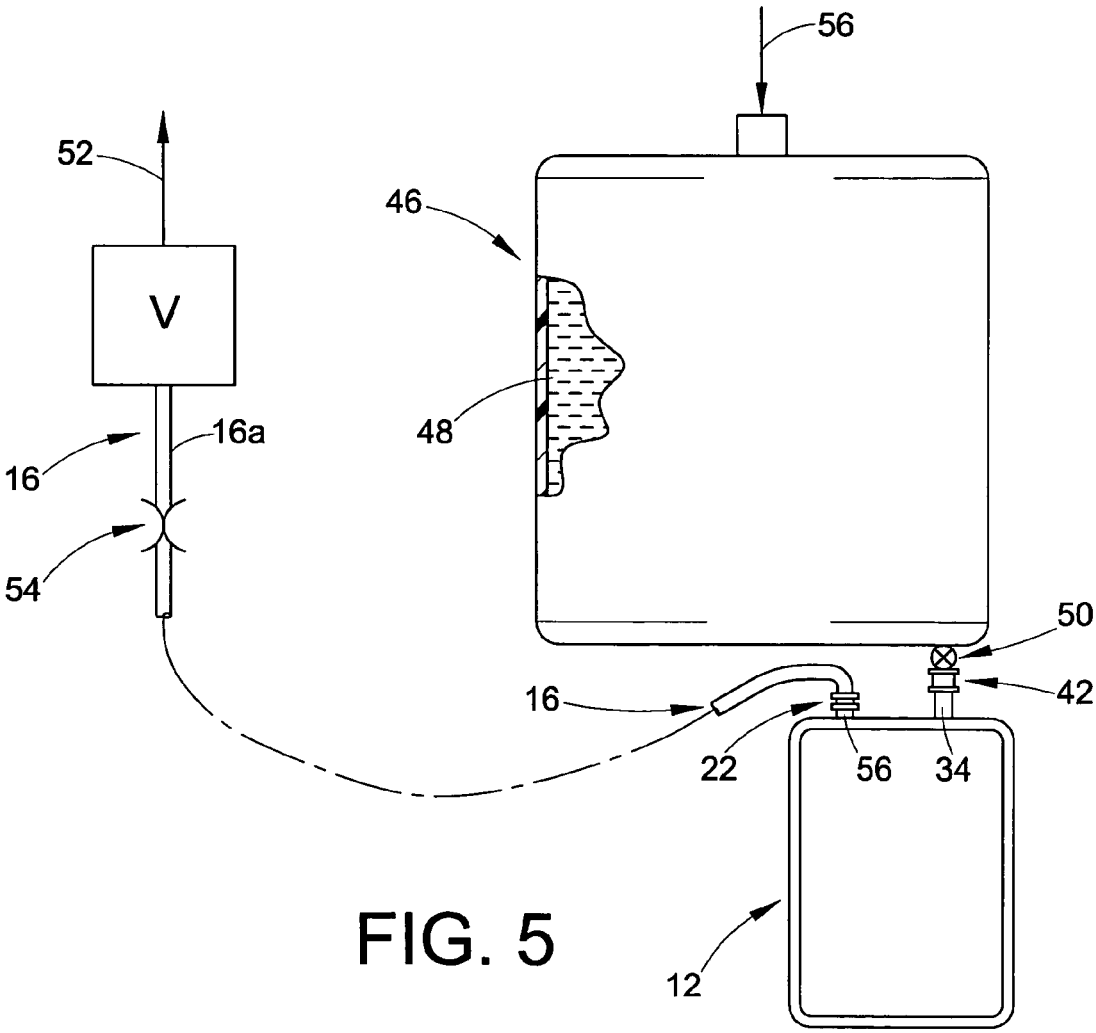

FIG. 5 schematically illustrates the components of a system for filling reservoir bag 12 with ink in accordance with the invention. More particularly in this respect, the system components include a source of ink 46 which may be in the form of a tank, bag or other container having a supply of ink 48 therein and having an outlet controlled by a shut off valve 50. The system further includes a vacuum source V which, as is set forth more fully hereinafter, is operable to withdraw air from bag 12 and tubing 16 in the direction of arrow 52. The end 16*a* of supply tubing 16 to be connected to coupling 24 on the cartridge extends through a manually operable pinch clamp 54 located about three inches from the end and is attached to vacuum source V. As shown by the solid line representation of clamp 54, the latter is initially in the unclamping condition relative to tubing 16, whereby the tubing is open. To fill a bag 12, the fill port thereof is connected to the outlet of supply 46 with valve 50 closed, and vacuum source V is then operated to withdraw air from bag 12 and tubing 16. Preferably, in this respect, a vacuum of 28.5" Hg is drawn through the exit port of the bag and tubing for 20 seconds, thus removing all of the air and placing the bag and tubing under a negative pressure. After the 20 seconds has elapsed, the tubing is clamped by pinch tube 54 to close the tubing as represented by the broken line position of the clamp. Valve 50 is then opened and ink 48 in container 46 is drawn into bag 12 and tubing 16 as a result of the vacuum therein and fills the latter with no or a minimum amount of air. Preferably, bag 12 is overfilled with ink so as to create a slight positive pressure above atmospheric pressure which facilitates dispersion of any air bubbles within the system during the early life of the cartridge and filling system. Depending on the characteristics of ink source 46, such overfilling and slight positive pressure can be achieved by the head of ink 48 in the receptacle and/or by applying air under pressure into the receptacle such as is indicated by arrow 56. After filling, clamp 54 is actuated to close tubing 16, valve 50 is closed and the inlet port of the bag is disconnected from the outlet of container 46 and is connected to coupling 24 of the cartridge.

Bag 12 is not used to initially fill ink cartridge 14. Rather, the latter is filled in the normal manner through an inlet in the bottom of the cartridge with air in the cartridge being purged through a vent in the top of the cartridge. Thus, when end 16*a* of the tubing is attached to coupling 24 of cartridge 14, air in end 16*a* ahead of clamp 54 enters the cartridge and is vented therefrom when clamp 54 is opened for ink to flow from bag 12 and tubing 16 into the cartridge.

While considerable emphasis has been placed herein on preferred embodiments of the invention, it will be appreciated that other embodiments can be devised and that many changes can be made in the preferred embodiments without departing from the principles of the invention. In this respect, for example, it is to be understood that a bag defined by folding a sheet of plastic material to provide overlying sheets bonded about the three unattached sides thereof is intended to correspond to a bag comprising two sheets of plastic material having peripheral edges bonded together as shown and described herein. Accordingly, it is to be distinctly understood that the foregoing descriptive matter is to be interpreted merely as illustrative of the invention and not as limitation and that it is intended to include other embodiments and all modifications of the preferred embodiments insofar as they come within the scope of the appended claims or the equivalents thereof.

Having thus described the invention, it is so claimed:

1. An ink reservoir bag for use in a continuous ink delivery system for an ink cartridge comprising, two sheets of plastic material having peripheral edges bonded together to provide an ink chamber therebetween, and separate fill and exit ports opening into said chamber and having outer ends outside said chamber, wherein the bag has first and second orthogonal dimensions with respect thereto, said first dimension being equal to or less than said second dimension, said bag having a thickness when filled with ink, and said first dimension being at least four times greater than said thickness.

2. A bag according to claim 1, wherein said fill and exit ports are adjacent one another along said perimeter.

3. A bag according to claim 2, wherein said perimeter is rectangular and includes opposed pairs of long and short sides, said fill and exit ports being in one of said short sides.

4. A bag according to claim 3, wherein said fill port includes a fill tube of plastic material and said exit port includes an exit tube of plastic material, said fill tube and said exit tube being between said peripheral edges.

5. A bag according to claim 4, wherein said sheets of plastic material are polyvinylchloride sheets having a thickness of 0.015 inch.

6. A bag according to claim 4, further including a check valve in said exit tube closing in the direction toward said chamber, and a fill valve in said fill tube opening in the direction toward said chamber.

7. A bag according to claim 6, wherein said sheets of plastic material are polyvinylchloride sheets having a thickness of 0.051 inch.

8. A bag according to claim 1, wherein said sheets of plastic material are polyvinylchloride sheets having a thickness of 0.015 inch.

9. A bag according to claim 8, further including a check valve in said exit port closing in the direction toward said chamber, and a fill valve in said fill port opening in the direction toward said chamber.

10. An ink reservoir bag for use in a continuous ink delivery system for an ink cartridge comprising two sheets of plastic material having peripheral edges bonded together to provide an ink chamber therebetween, and separate fill and exit ports opening into said chamber and having outer ends outside said chamber, further including a check valve in said exit port closing in the direction toward said chamber, and a fill valve in said fill port opening in the direction toward said chamber.

11. A method of filling an ink reservoir bag for use in a continuous ink delivery system for an ink cartridge comprising the steps of:

providing a reservoir bag of flexible plastic sheet material having separate fill and exit ports, connecting a length of plastic tubing to said exit port, removing the air from the bag and tubing, closing the tubing at a location therealong spaced from the bag, filling the bag and tubing through said inlet port, and removing the air from the bag and tubing by connecting the tubing to a vacuum source.

12. The method of claim 11 and drawing a vacuum of 28.5" Hg on the tubing and bag.

13. The method of claim 12, and drawing the vacuum for 20 seconds.

14. The method of claim 13, and closing the tubing by clamping the tubing at said location.

15. The method of claim 14, and filling the bag and tubing by connecting the fill port to an ink supply source.

16. The method of claim 15, and filling the bag for the ink in the bag to be at a pressure above atmospheric pressure.

* * * * *